US005114366A

United States Patent [19]

Sato

[11] Patent Number: 5,114,366

[45] Date of Patent: * May 19, 1992

[54] ELECTRICAL CONNECTOR AND METHOD OF LOADING SAME

[75] Inventor: Kensaku Sato, Tokyo, Japan

[73] Assignee: Hirose Electric Co., Ltd., Tokyo, Japan

[ * ] Notice: The portion of the term of this patent subsequent to Aug. 20, 2008 has been disclaimed.

[21] Appl. No.: 610,927

[22] Filed: Nov. 9, 1990

[30] Foreign Application Priority Data

Nov. 15, 1989 [JP] Japan ..... 1-294931

[51] Int. Cl.[5] ..... H01R 17/04

[52] U.S. Cl. ..... 439/585; 439/610

[58] Field of Search ..... 439/98, 607, 610, 394

[56] References Cited

U.S. PATENT DOCUMENTS 4,737,124 4/1988 Ezure et al. ..... 439/610
4,810,210 3/1989 Komatsu ..... 439/610
4,948,382 8/1990 Marpoe, Jr. et al. ..... 439/397
4,954,097 9/1990 Sekiguchi ..... 439/610

FOREIGN PATENT DOCUMENTS 1077744 3/1960 Fed. Rep. of Germany ..... 439/607

*Primary Examiner*—Gary F. Paumen
*Attorney, Agent, or Firm*—Kanesaka & Takeuchi

[57] ABSTRACT

An electrical connector for a shield cable which includes a shield sleeve portion (3) including a contact holding portion (6) having a pair of opposed jig entrances (10*a*), a shield wires crimping portion (7) having a pair of crimping tabs (12), and an outer sheath crimping portion (8) having a pair of crimping tabs (13); and a signal line contact (5) having a contact body (14) and an insulation displacement portion (15) with an insulation displacement contact (17) to which a signal line of the shield cable is to be connected by insulation displacement, said signal line contact being placed within the contact holding portion via an insulator body (4) so that the insulation displacement portion is positioned between the jig entrance.

3 Claims, 7 Drawing Sheets

ELECTRICAL CONNECTOR AND METHOD OF LOADING SAME

BACKGROUND OF THE INVENTION

1. Field of the Invention

The present invention relates to an electrical connector for shield cables of electronic controls in an automobile, for example, and methods of loading such a cable on the electrical connector.

2. Description of the Prior Art

FIG. 16 shows a conventional connector of this type which is connected by removing a length of outer sheath g of a shield cable a; separating shield wires b from a signal line c, bundling and connecting the shield wires b and the signal line c to the contact terminal e and the insulation displacement terminal f of a connector body d, respectively.

However, the removal of the outer shield g, the separation of the shield wires b from the signal line c, and the direction of the shield wires b and the signal line c to the contact terminals e and f have been made by hands. The shield wires b and the signal line c have been connected separately to the contact terminals e and f by bundling the shield wires b while using the insulation displacing technique for the signal line c. Consequently, it has been difficult to streamline and automate the connection operations. In addition, the signal line c from which the shield wires b were removed has been susceptible to electromagnetic interferences.

SUMMARY OF THE INVENTION

Accordingly, it is an object of the invention to provide a connector which permits simultaneous connection by insulation displacement of the signal line and by crimping of the shield wires and outer sheath of a shield cable, thereby making possible continuous and automatic connection of a large number of connectors.

It is another object of the invention to provide a connector which requires small pressures for making connections, thus requiring small insulation displacing and crimping tools.

It is still another object of the invention to provide a connector which has the enhanced shielding effect.

It is yet another object of the invention to provide a method of loading a cable on the above connector.

According to one aspect of the invention there is provided an electrical connector for a shield cable which includes a shield sleeve portion including a contact holding portion having a jig entrance extending forwardly from a rear edge thereof, a shield wires crimping portion having a pair of crimping tabs, and an outer sheath crimping portion having a pair of crimping tabs; and a signal line contact having a contact body and an insulation displacement portion with an insulation displacement contact to which a signal line of the shield cable is to be connected by insulation displacement and placed within the contact holding portion via an insulator body so that the insulation displacement portion is positioned within the jig entrance.

According to another aspect of the invention there is provided a method of loading a shield cable on the above electrical connector, which includes the steps of placing a signal line, and shield wires and an outer sheath of a shield cable on the insulation displacement contact, and the shield crimping tabs and the outer sheath crimping tabs, respectively; and simultaneously pressing the signal line and the crimping tabs with an insulation displacing tool and a crimping tool to effect simultaneous connection of the signal line and the shield wires and outer sheath.

The stripped front end of a shield cable is placed on the electrical contact such that the signal line and the shield wires and outer sheath are positioned on the insulation displacement contact and the shield and sheath crimping tabs. The signal line and the crimping tabs are simultaneously pressed with an insulation displacement and crimping tools so that the signal line and the shield wires and outer sheath are simultaneously connected to the insulation displacement contact and the crimping tabs, respectively.

The above and other objects, features, and advantages of the invention will be more apparent when taken in conjunction with the accompanying drawings.

DESCRIPTION OF THE PREFERRED EMBODIMENT

Figure 1:
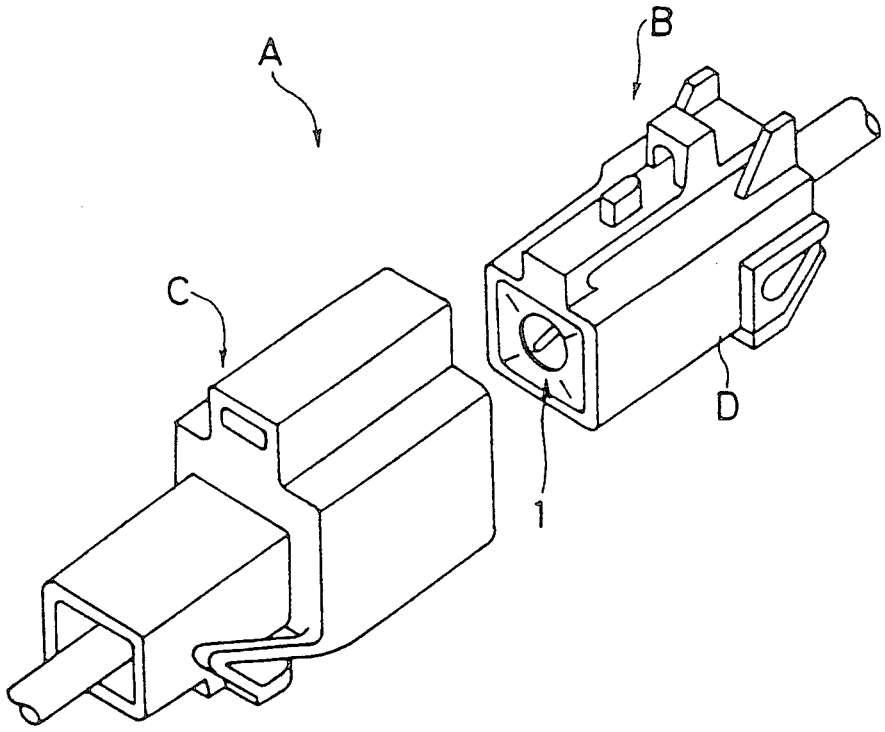
FIG. 1 is a perspective view of a connector according to an embodiment of the invention before coupling.

FIG. 1 shows a connector according to an embodiment of the invention before coupling. A connector A consists of a female connector B and a male connector C. The female connector B includes a housing D and an electrical contact terminal 1 therein.

As FIGS. 2-9 show, the electrical contact terminal 1 includes a shield sleeve 3, an insulation body 4, and a signal contact 5. The shield sleeve 3 is divided into three portions; a tubular holder portion 6, a shield wires crimping portion 7, and a sheath retention portion 8. Behind the contact holder portion 6 there are jig entrances 10*a* and 10*b*. The jig entrance 10*a* extends forwardly from the rear edge 6*a* of the contact holder portion 6. The shield crimping portion 7 has a pair of crimping tabs 12 forming a U-shaped cross section. The sheath retention portion 8 also has a pair of crimping tabs 13 forming a U-shaped cross section. The crimping tabs 13 are greater than the crimping tabs 12.

The signal line contact 5 is divided into three portions: a contact body 14, a signal line insulation displacing portion 15, and an insulator crimping portion 16. The contact body 14 has the form of a pin while the insulation displacing portion 15 consists of a pair of insulation displacing contacts 17 with a U-shaped slit 11. The insulator crimping portion 16 has a pair of crimping tabs 18 forming a U-shaped cross section. The signal line contact 5 is supported by the insulator 4 within the contact holder portion 6 of the contact terminal 1 such that the insulation displacing portion 15 and the insulator crimping portion 16 are placed in the jig entrance 10*a* and the jig entrances 10*a* and 10*b*, respectively.

Figure 2:
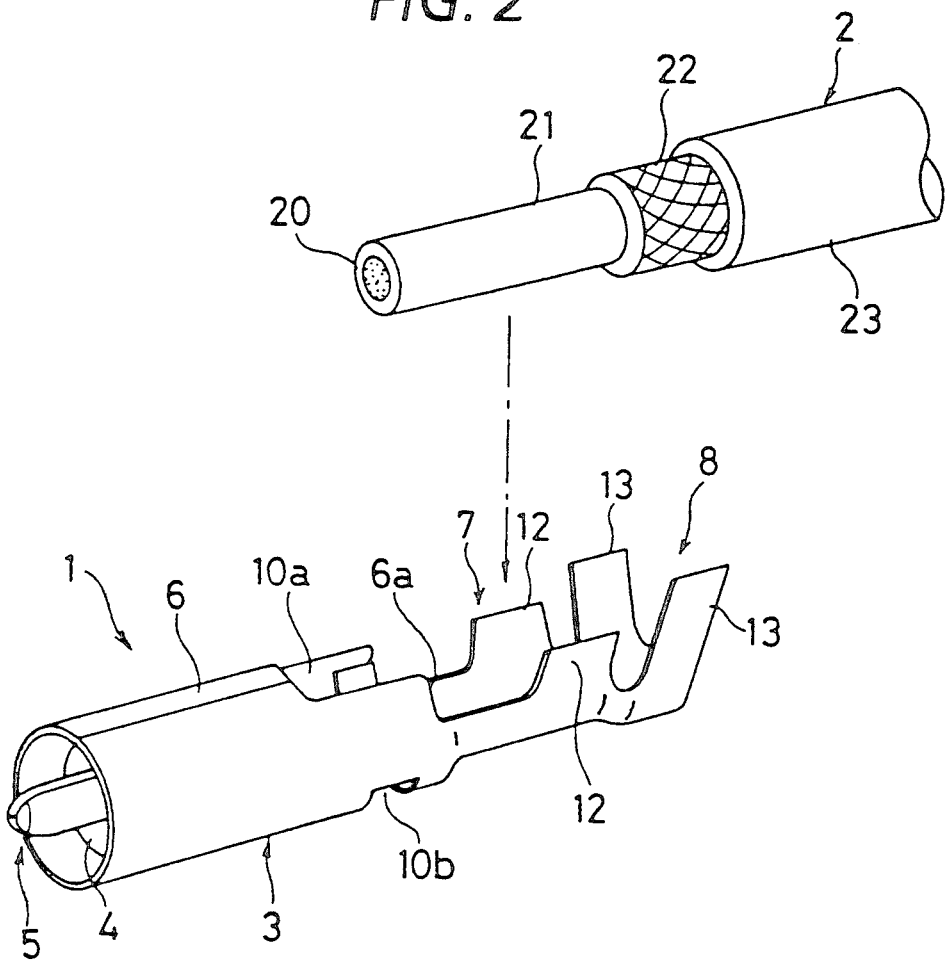
FIG. 2 is a perspective view of an electrical contact terminal of the connector.
Figure 3:
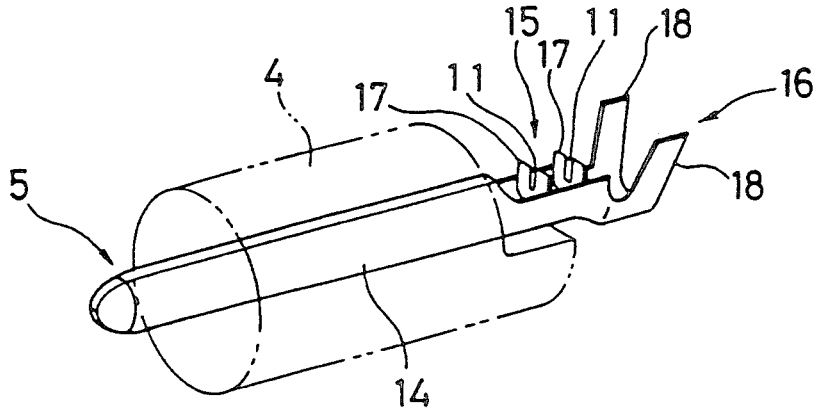
FIG. 3 is a perspective view of a signal line contact of the connector.
Figure 4:
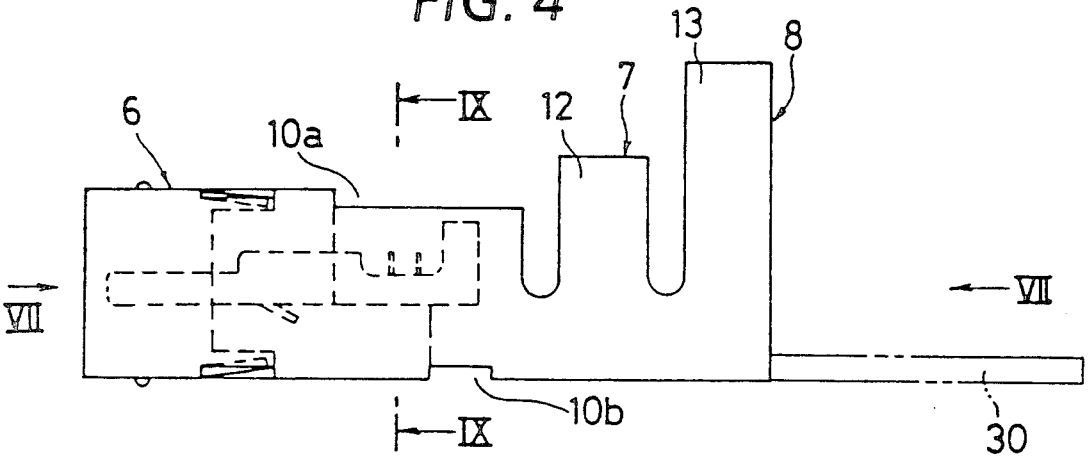
FIG. 4 is a side elevation of the electrical contact terminal.
Figure 5:
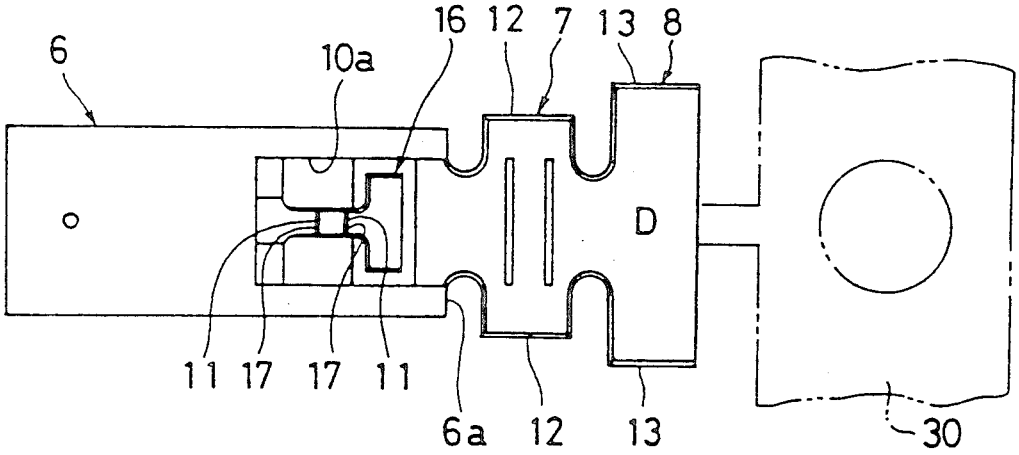
FIG. 5 is a top plan view thereof.
Figure 6:
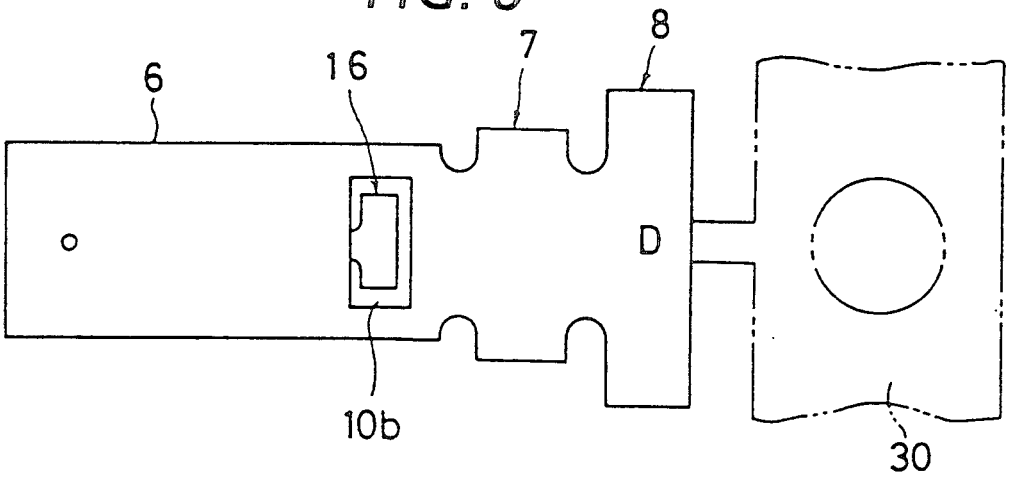
FIG. 6 is a bottom plan view thereof.
Figure 7:
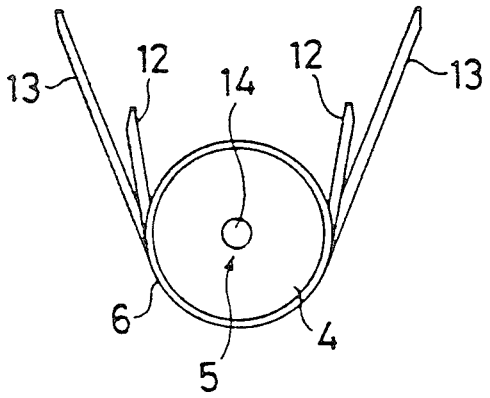
FIG. 7 is a front elevation thereof viewed from the arrow VII—VII of FIG. 4.
Figure 8:
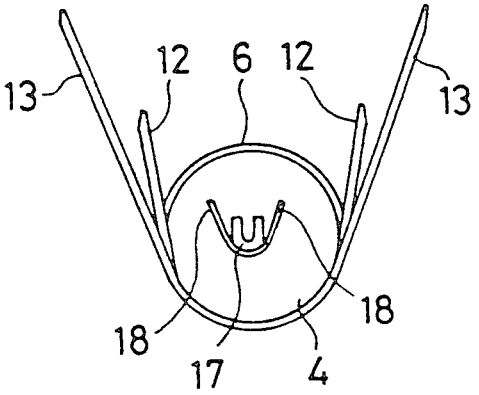
FIG. 8 is a rear elevation thereof viewed from the arrow VIII—VIII of FIG. 4.
Figure 9:
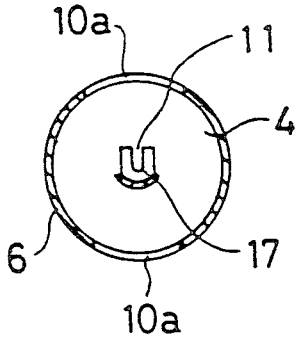
FIG. 9 is a sectional view taken along the line IX—IX of FIG. 4.

In order to connect the shield cable 2 to the contact terminal 1, as FIG. 2 shows, a length of outer sheath 23 is removed from the shield cable 2 to expose the insulated conductor 20 with an insulator 21 and the shield wires 22. The shield cable 2 is placed on the contact terminal 1 such that the signal line 20, the intermediate insulator 21, the shield wires 22, and the outer sheath 23 are positioned at the insulation displacing slits 11, the insulator crimping tabs 18 of the insulator crimping portion 16, the crimping tabs 12 of the shield wires crimping portion, and the crimping tabs 13 of the sheath holder portion 3, respectively.

Figure 10:
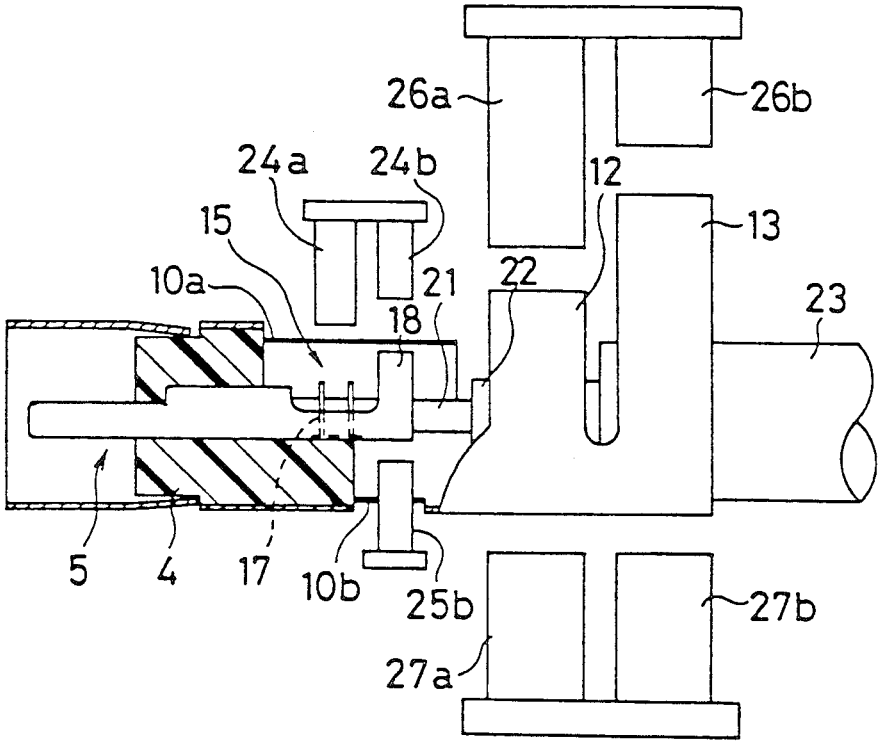
FIG. 10 illustrates how to crimp a shield cable to the electrical contact terminal.
Figure 11:
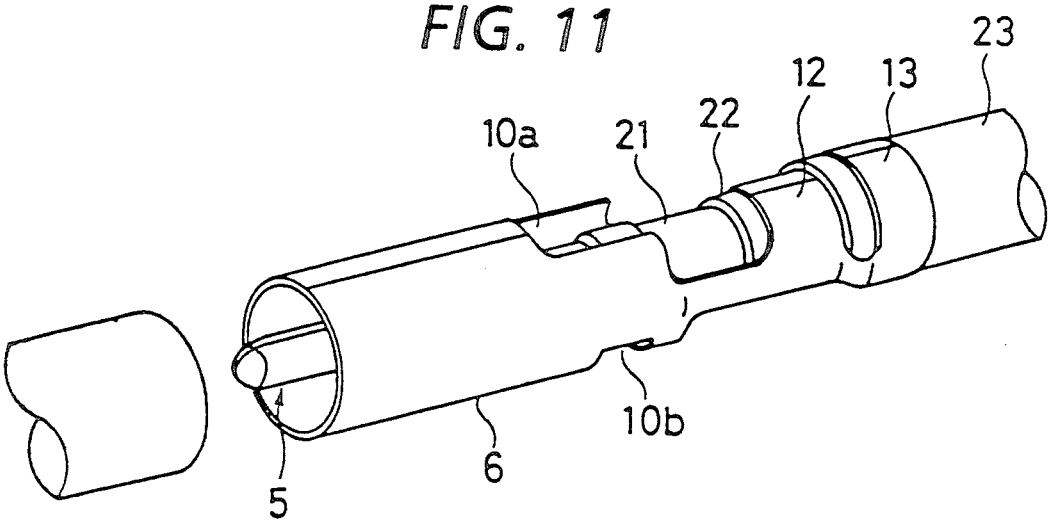
FIG. 11 illustrates the electrical contact terminal to which the shield cable has been crimped.
Figure 12:
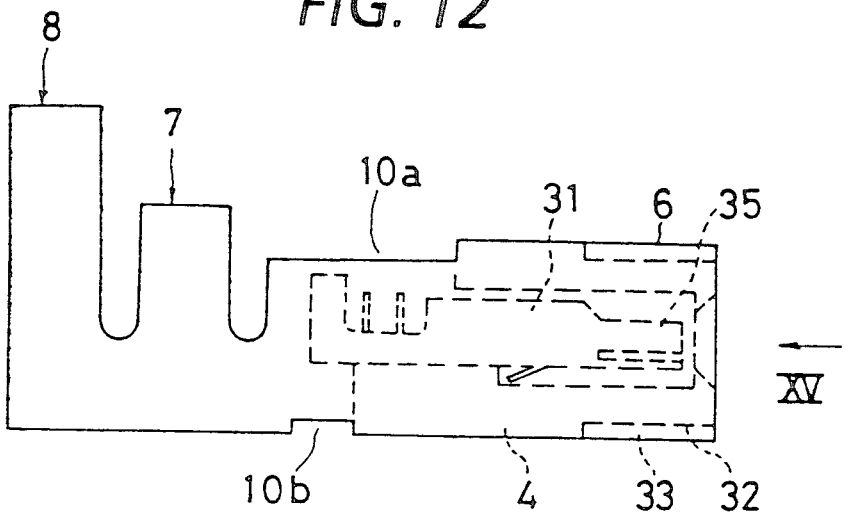
FIG. 12 is a side elevation of a male connector according to an embodiment of the invention.
Figure 13:
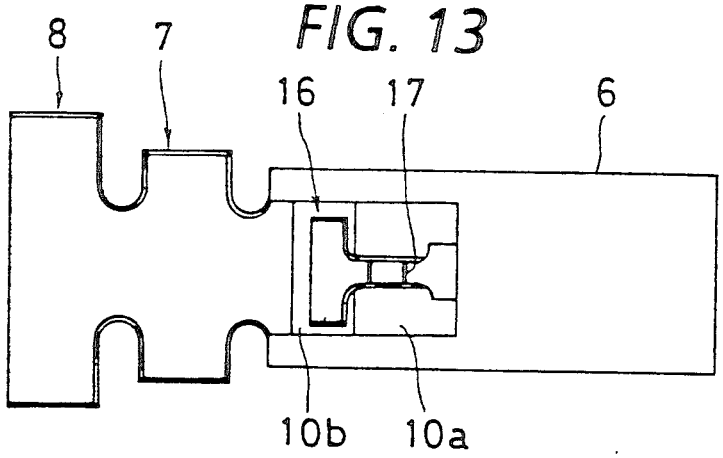
FIG. 13 is a top plan view thereof.
Figure 14:
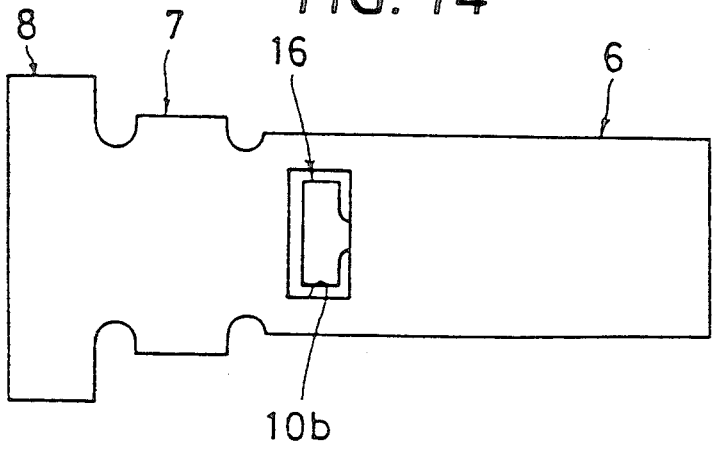
FIG. 14 is a bottom plan view thereof.
Figure 15:
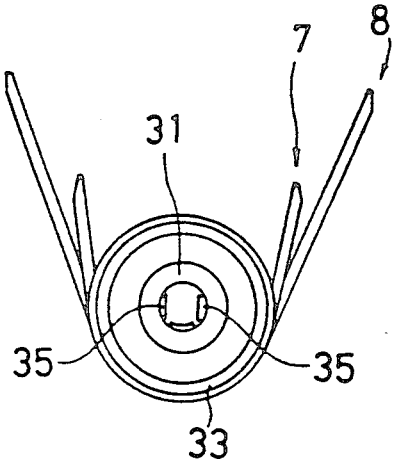
FIG. 15 is a front elevation thereof viewed from the arrow XV—XV of FIG. 12.
Figure 16:
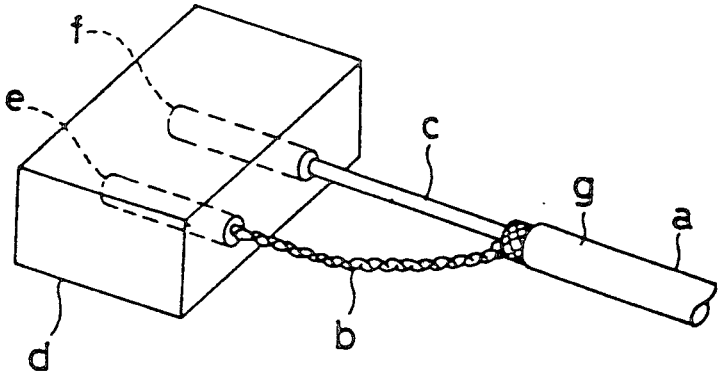
FIG. 16 PRIOR ART
FIG. 16 is a perspective view of a conventional connector.

As FIG. 10 shows, the signal line 20, the intermediate insulator 21, the shield wires 22, and the outer sheath 23 are placed and connected to the insulation displacing contact 17, and the crimping tabs 18, 12, and 13, at once by insulation displacement and crimping techniques, respectively, by means of anvils 24*a*, and anvils 24*b*, 26*a*, and 26*b*, and crimpers 25*b*, 27*a* and 27*b* which are 25 crimping tools. More specifically, the insulation displacing anvil 24*a* is inserted through the jig entrance 10*a* to press the signal line 20 onto the insulation displacing contact 17 for effecting connection. At the same time, the crimping anvil 24*b* is inserted through the jig entrance 10*a* while the crimper 25*b* is inserted through the jig entrance 10*b* to press the crimping tabs 18 to grip the intermediate insulator 21. In addition, the crimping tabs 12 and 13 are crimped to the shield wires 22 and the outer sheath 23 with the crimping anvils 26*a* and 26*b* and the crimpers 27*a* and 27*b*, respectively, to connect the shield cable 2 to the electrical contact 1 as shown in FIG. 11. The electrical contact 1 is then inserted and fixed in the housing D to form a female connector B.

In order to successively connect a large number of contact terminals 1 to shield wires 2, a metal sheet 30 is stamped and formed into a large number of shield sleeves 3 with a portion of the metal sheet left. The terminal strip 30 wound about a reel (not shown) are unwound to be successively connected to the shield wires 2 as described above. Since the signal lines 20 are connected by insulation displacement, the pressure required for the connection is lower than that of the crimping method so that it is possible to use small insulation displacement tools or machines, resulting in the lower costs for the equipment.

In addition, the insulator crimping portion 16 of the signal line contact 5 is not necessarily required so that only one jig entrance for insulation displacement of the signal line 20 is necessary. Consequently, when the shield wires 2 are connected to the female connector B, the coverage by the shield sleeve 3 of the signal line 20 and the signal line contact 5 increases, thereby enhancing the shield effect.

As FIGS. 12–15 show, the male connector C is the same as the female connector B except for a male signal contact 31 and a fitting cavity 33 which is formed between an annular recess 32 of the insulation body 4 and the contact holder portion 6. Unlike the signal line contact 5 of the female connector B, a contact body 34 of the signal contact 31 has a number of contact pieces 35 circularly arranged so as to receive the contact pin 14 of the signal line contact 5. The contact body 14 of the female connector B is inserted into the contact body 34 of the male connector C so that the front end of the contact holder 6 fits into the fitting cavity 33 for effecting connection between the connectors B and C.

Alternatively, the male connector C may be of the type the connection side of which is directly mounted on a printed circuit board. The insulator crimping portion of a signal line contact is not necessarily required.

As has been described above, with the connector according to the invention, it is possible to simultaneously connect the signal line to an insulation displacing contact with an insulation displacing tool and the shield wires and the outer sheath to crimping tabs with crimping tools. This makes continuous connection of a large number of connectors possible and thus automation of the operation possible.

The pressure used for insulation displacement is lower than that of crimping, and only one jig entrance for the insulation displacing tool is required. Consequently, the coverage by the shielding sleeve of the signal line and signal line contact increases and thus the shielding effect.

I claim:

1. An electrical connector for a shield cable comprising:

a shielding sleeve portion including a contact holding portion having a pair of opposed jig entrances, a shield wires crimping portion having a pair of crimping tabs, and an outer sheath crimping portion having a pair of crimping tabs; and a signal line contact having a contact body, an insulator crimping portion, and an insulation displacement portion with an insulation displacement contact to which a signal line of said shield cable is to be connected by insulation displacement, said signal line contact being placed within said contact holding portion via an insulator body so that said insulator crimping portion is positioned between said jig entrances, said jig entrances being large enough to accept crimping tools so as to allow said shield wires crimping portion and said insulator crimping portion to be simultaneously crimped.

2. An electrical connector for a shielded cable, which comprises:

a shielding sleeve having a contact holding portion, a shield wires crimping portion, and an outer sheath crimping portion, said contact holding portion having a pair of opposed upper and lower jig entrances;

an insulation body placed within said contact holding portion such that its rear portion is exposed through said upper jig entrance;

a signal line contact having a contact body, an insulation displacement portion, and an insulator crimping portion and supported by said insulation body such that said insulation displacement portion is placed on said rear portion of said insulation body while said insulator crimping portion projects from said rear portion into a space between said upper and lower jig entrances; and said upper and lower jig entrances being large enough to accept crimping tools so as to allow said shield wires crimping portion and said insulator crimping portion to be simultaneously crimped.

3. The electrical connector of claim 2, wherein said upper jig entrance is larger than said lower jig entrance.

* * * * *